US006369760B1

(12) United States Patent
Nalbandian et al.

(10) Patent No.: US 6,369,760 B1
(45) Date of Patent: Apr. 9, 2002

(54) COMPACT PLANAR MICROSTRIP ANTENNA

(75) Inventors: Vahakn Nalbandian, Ocean; Choon S. Lee, Dallas, both of NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/663,979

(22) Filed: Sep. 19, 2000

Related U.S. Application Data

(63) Continuation-in-part of application No. PCT/US99/15657, filed on Jul. 12, 1999.

(51) Int. Cl.[7] ..... H01Q 1/38
(52) U.S. Cl. ..... 343/700 MS; 343/846
(58) Field of Search ..... 343/700 MS, 846; H01Q 1/38

(56) References Cited

U.S. PATENT DOCUMENTS 5,657,028 A * 8/1997 Sanad ..... 343/700 MS
5,926,139 A * 7/1999 Korisch ..... 343/700 MS
6,133,880 A * 10/2000 Grangeat et al. .... 343/700 MS

OTHER PUBLICATIONS

J.S. McLean, "A Re–Examination of the Fundamental Limits on the Radiation Q of Electrically Small Anenna", IEEE trans, Anrenna Propagation, vol. 44, pp. 672–676, May 1996.

* cited by examiner

*Primary Examiner*—Hoanganh Le
(74) *Attorney, Agent, or Firm*—Michael Zelenka; George B. Tereschuk

(57) ABSTRACT

A first and a second conductive patch of a compact planar microstrip antenna are connected at a junction point to shorten the length of the impedance transition from the center point, where the wave impedance vanishes, to the patch edge, where the impedance becomes very large. The second conductive patch is wider than the first conductive patch and one end of the first conductive patch is shorted with the ground plane. The effective impedance to be satisfied by the narrower strip at the junction is greatly reduced by the presence of the junction of two different patches, which decreases the size of the antenna greatly for the required frequency range.

13 Claims, 2 Drawing Sheets

COMPACT PLANAR MICROSTRIP ANTENNA

This application is a Continuation-In-Part of PCT/US99/15657, entitled "Compact Planar Microstrip Antenna," which designated the United States and was filed on Jul. 12, 1999 in the United States Patent & Trademark Office as a PCT Receiving Office under the procedures of the Patent Cooperation Treaty, by the same inventors herein. This Continuation-In-Part is being filed under 35 USC §120 and 35 USC §365, 37 CFR §1.53, and MPEP §1895 and priority from that application is claimed.

GOVERNMENT INTEREST

The invention described herein may be manufactured, used, imported, sold, and licensed by or for the Government of The United States of America without the payment to me of any royalty thereon.

FIELD OF THE INVENTION

The present invention relates generally to the field of microstrip antennas, and more particularly to compact planar microstrip antennas.

BACKGROUND OF THE INVENTION

Microstrip antennas are of lightweight, low profile, low cost and planar structure, replacing bulky antennas. The length of a rectangular microstrip antenna is about a half wavelength within the dielectric medium under the radiating patch, which is still relatively large at UHF and VHF frequencies, but these frequencies can impose size limitations resulting in bulky and cumbersome antenna structures.

Previously due to the size limitation at UHF and VHF frequencies, microstrip antennas were mainly limited to applications at higher frequencies. The disadvantage of size limitations in UHF and VHF has created a long-felt need to reduce antenna length. Up until now, it has not been possible to employ planar microstrip antennas without-the disadvantages, limitations and shortcomings associated with antenna length and size. The present invention males it possible to have electrically small planar microstrip antenna at low frequencies.

The need for electrically small planar microstrip antenna at low frequencies offers a number of advantages over prior art antennas. The compact planar microstrip antenna of the present invention provides the same high efficiency as conventional microstrip antennas. However, the present invention provides a key advantage over prior art antenna structures by requiring a substantially shorter antenna length, without suffering from the size limitations of prior art antenna structures. In one embodiment of the present invention, a reduced antenna length of at least 18% of the length of a conventional microstrip antenna has been achieved, resulting in small microstrip antennas at low frequencies such as UHF and VHF.

A prior art reference on conventional microstrip antennas is J. S. McLean, IEEE Trans, Antennas and Propagation, "A Re-Examination of the Fundamental Limits on the Radiation Q of Electrically Small Antenna" Vol. 44, pp 672–676, May 1996

SUMMARY OF THE INVENTION

The purpose of this invention is to introduce a compact planar microstrip antenna by reducing the antenna lengths to less than 18% of the length of a conventional microstrip antenna. Many military and commercial communication systems need compact, low-cost, rugged, and conformal antennas; as well as ground vehicle, aircraft and space antennas. In commercial systems, wireless communication systems need this antenna.

This invention provides the excellent properties of microstrip material (low cost, compact, planar and conformal) to design and fabricate electrically small planar microstrip UHF and VHF antennas.

DETAILED DESCRIPTION OF THE DRAWINGS

Figure 1:
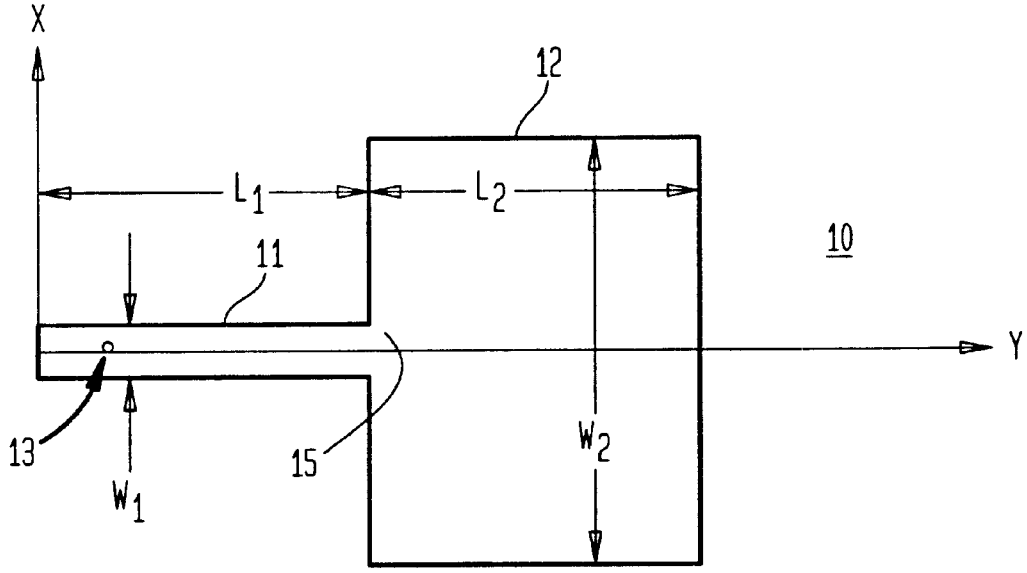
FIG. 1 is a top view of the first and second conductive patches of the compact planar microstrip antenna of the present invention.

The size of a microstrip antenna is determined by the wavelength within the substrate. For example, the length of a rectangular microstrip antenna is about half of the wavelength within the dielectric medium under the radiating patch. In order to reduce the patch size, the dielectric constant must be increased substantially for a smaller effective wavelength in the medium. The antenna's efficiency usually goes down with a substrate of high dielectric constant.

The principle of this new compact antenna is to introduce a junction in the middle of the patch where first and second conductive patches meet at a junction to shorten the length of the impedance transition from the center point (where the wave impedance vanishes) to the patch edge of the second larger conductive patch (where the impedance becomes very large). The simplest example of this invention is a microstrip antenna having a dual rectangular patch 10 comprising two rectangular conductive patches 11 and 12, respectively, of different widths, $W_1$ and $W_2$, respectively connected to each other, where one end of the narrower first patch 11 near SMA pin 13 is shorted to the ground plane 20 of FIG. 2. The effective impedance to be satisfied by the narrower strip 11 at the junction 15 is greatly reduced by the presence of the junction of the two different first and second conductive patches, 11 and 12, respectively. This should decrease the size of the FIG. 2 antenna 30 greatly for the required frequency range.

Figure 2:
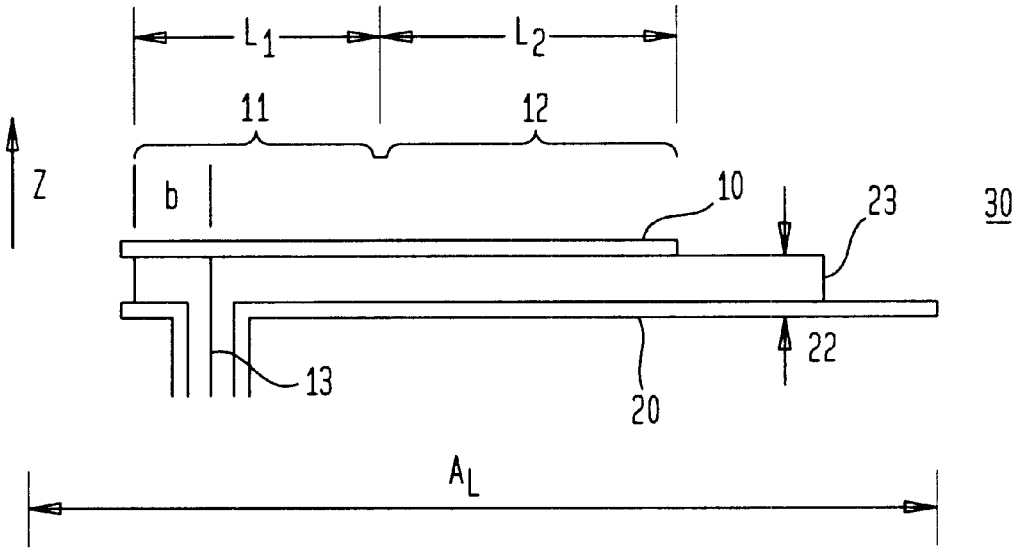
FIG. 2 is a side view of the compact planar microstrip antenna of the present invention.

Referring now to FIG. 2, which is a side view of the compact planar microstrip antenna 30 of the present invention, the dual rectangular patch 10 is shown disposed a top planar surface of a dielectric substrate 23, which is disposed on the ground plane 20. A shorting means 21 connects the first conductive patch 11 to ground plane 20. This drawing also depicts SMA pin 13 functioning as a coaxial feed to the first conductive patch 11.

FIGS. 1 and 2 also depict representative dimensions of the compact planar microstrip antenna 30 of the present invention. Referring back to FIG. 1, the length $L_1$ of the first conductive patch 11 is 10.0 mm and the length $L_2$ of the second conductive patch 12 is 12.6 mm. The width $W_1$ of first patch 11 is 3.3 mm, and the width $W_2$ of second patch 12 is 50.0 mm. In the present invention it is critical for the second patch 12 to be wider than first patch 11 to achieve the advantageous shortened antenna length at a given frequency.

Referring back to FIG. 2, a dielectric substrate 23, having a height 22 of 1.55 mm, separates dual rectangular patch 10 from ground plane 20. The distance b between the shorted end 21 of first conductive patch 11 and SMA pin 13 is 1.6 mm. The dielectric substrate 23 disposed on the ground plane 20 had a dielectric constant of 2.2.

Figure 3:
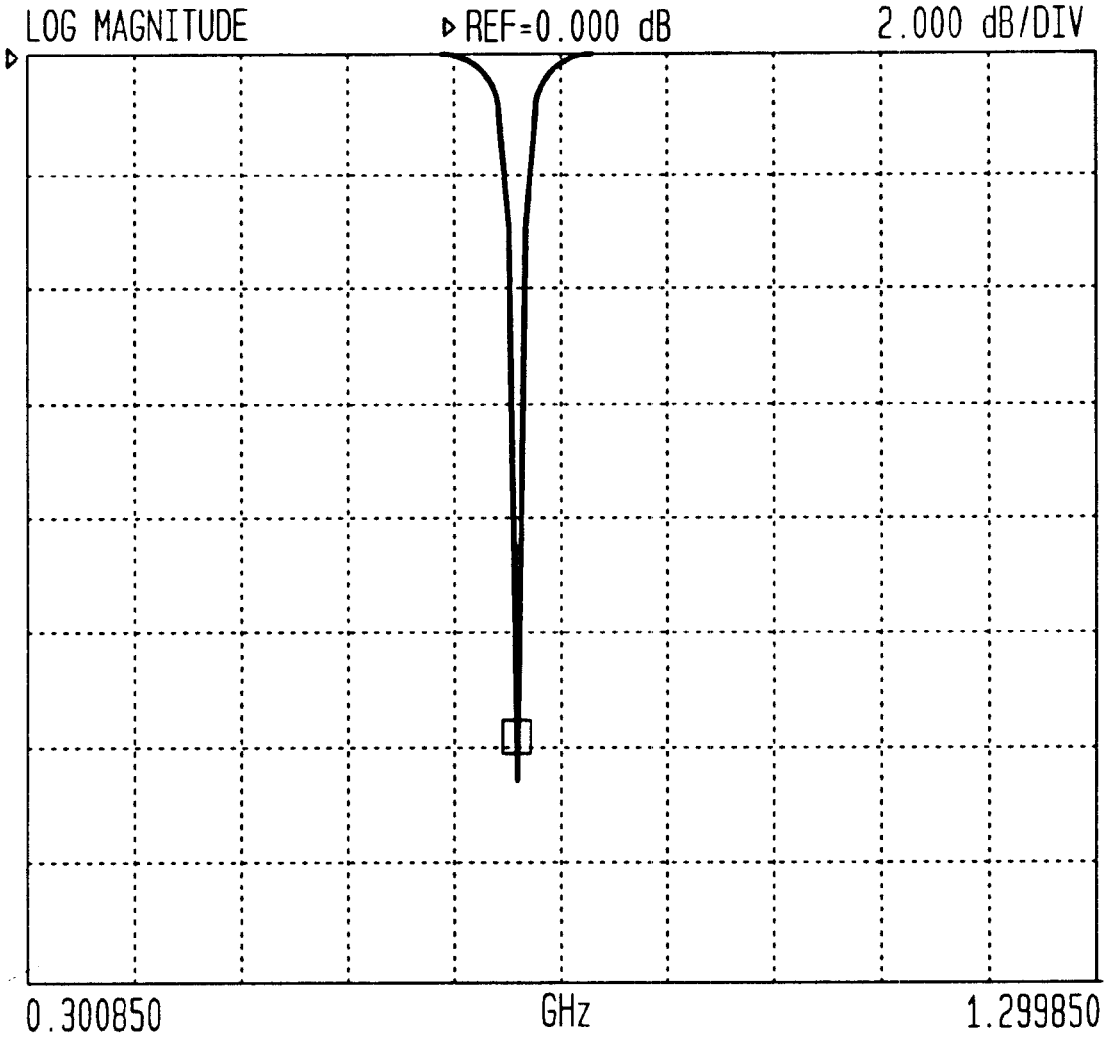
FIG. 3 is a graph showing return loss as a function of frequency for the compact planar microstrip antenna of the present invention.

A test on a simple dual rectangular patch antenna of different widths (FIGS. 1 and 2) was conducted and the initial results showed its return loss (FIG. 3) or resonant frequency of 0.754 GHz. A conventional microstrip antenna of the same length (22.6 mm) and the same dielectric constant of 2.2 will have a resonant frequency of 4.2 GHz. Therefore a shrinkage in the size of the antenna to less than 18% is claimed. It is possible the size can be reduced further with design improvements.

It is to be understood that such other features and modifications to the foregoing detailed description are within the contemplation of the invention, which is not limited by this description. As will be further appreciated by those skilled in the art, any number of configurations, as well any number of combinations of circuits and differing materials and dimensions can achieve the results described herein. Accordingly, the present invention should not be limited by the foregoing description, but only by the appended claims.

What we claim is:

1. A compact planar microstrip antenna, comprising:

a dielectric substrate being disposed on a conductive ground plane, said dielectric substrate having a top planar surface;

said antenna having a given length;

a first conductive patch placed on said top planar surface, said first conductive patch having a width, $W_1$;

said first conductive patch, having a shorted end shorted to said ground plane, being connected to a coaxial probe;

a second conductive patch placed on a second portion of said top planar surface being adjacent to said first conductive patch;

said second conductive patch, having a central region with a given impedance, an outer patch region and a width, $W_2$, greater than said width, $W_1$, being connected to said first conductive patch in proximity to said central region at a junction point opposing said shorted end of the first conductive patch;

said dielectric substrate having an effective impedance value;

said first conductive patch causing a reduced effective impedance at said junction point, said reduced effective impedance being lesser than said effective impedance; and said reduced effective impedance providing an antenna length, $A_L$, shorter than said given length.

2. The compact planar microstrip antenna, as recited in claim 1, further comprising:

said first conductive patch being rectangular; and said second conductive patch being rectangular.

3. The compact planar microstrip antenna, as recited in claim 2, further comprising a resonant frequency of 0.754 GHz.

4. The compact planar microstrip antenna, as recited in claim 3, further comprising an increase in said antenna length decreases said resonant frequency.

5. The compact planar microstrip antenna, as recited in claim 4, further comprising said second conductive patch having a longitudinal length, $L_2$, being greater than a longitudinal length, $L_1$, of said first conductive patch.

6. The compact planar microstrip antenna, as recited in claim 5, further comprising said antenna length being greater than said longitudinal length, $L_2$.

7. The compact planar microstrip antenna, as recited in claim 6, further comprising:

a ratio of said width $W_2$/said width $W_1$; and as said ratio increases, said antenna length, $A_L$, decreases.

8. A compact planar microstrip antenna, comprising:

a dielectric substrate being disposed on a conductive ground plane, said dielectric substrate having a top planar surface;

said antenna having a given length;

a conductive patch on said top planar surface of the ground plane, said conductive patch having a narrow portion and a wide portion;

said narrow portion, having a width, $W_1$, and a shorted end shorted to said ground plane, being connected to a coaxial probe;

said wide portion, having a central region with a given impedance, an outer patch region and a width, $W_2$, greater than said width, $W_1$;

said central region being in proximity to said narrow portion and having a junction point opposing said shorted end;

said dielectric substrate having an effective impedance value;

said narrow portion causing a reduced effective impedance at said junction point, said reduced effective impedance being lesser than said effective impedance; and said reduced effective impedance providing an antenna length, $A_L$, shorter than said given length.

9. The compact planar microstrip antenna, as recited in claim 8, further comprising a resonant frequency of 0.754 GHz.

10. The compact planar microstrip antenna, as recited in claim 9, further comprising an increase in said antenna length decreases said resonant frequency.

11. The compact planar microstrip antenna, as recited in claim 10, further comprising said wide portion of the conductive patch having a longitudinal length, $L_2$, being greater than a longitudinal length, $L_1$, of said narrow portion of the conductive patch.

12. The compact planar microstrip antenna, as recited in claim 11, further comprising said antenna length being greater than said longitudinal length, $L_2$.

13. The compact planar microstrip antenna, as recited in claim 12, further comprising:

a ratio of said width $W_2$/said width $W_1$; and as said ratio increases, said antenna length, $A_L$, decreases.

* * * * *